US005634302A

United States Patent [19]

Lee

[11] Patent Number: 5,634,302

[45] Date of Patent: Jun. 3, 1997

[54] DEVICE FOR TEMPORARILY POSITIONING A FRAME TO BE CONNECTED SECURELY TO A CONCRETE WALL DURING CONSTRUCTION OF THE CONCRETE WALL

[76] Inventor: Wen-Yuan Lee, 7F-3, No. 8, Lane 390, Sec. 1, Chien-Kang Rd., Tainan City, Taiwan

[21] Appl. No.: 423,205

[22] Filed: Apr. 17, 1995

[51] Int. Cl.[6] ..... E04G 15/02; E04B 21/04

[52] U.S. Cl. ..... 52/127.3; 52/215; 52/745.15; 249/39

[58] Field of Search ..... 52/127.2, 127.3, 52/127.6, 127.8, 745.15, 745.16, 580, 215, 213; 249/39, 91, 93

[56] References Cited

U.S. PATENT DOCUMENTS

| | | | |
|---|---|---|---|
| 1,881,971 | 10/1932 | Roedig | 249/39 X |
| 2,602,983 | 7/1952 | Troiel | 249/39 X |
| 3,217,455 | 11/1965 | Burges | 52/580 X |
| 3,403,486 | 10/1968 | Schubeis | 52/127.2 |
| 3,994,470 | 11/1976 | Nakada | 249/39 X |
| 4,065,540 | 12/1977 | Okami | 249/39 X |
| 4,589,624 | 5/1986 | Jones | 249/39 X |

FOREIGN PATENT DOCUMENTS

| | | | |
|---|---|---|---|
| 4124374 | 4/1992 | Japan | 249/39 |
| 1 141 631 | 1/1969 | United Kingdom . | |
| 2 285 653 | 7/1995 | United Kingdom . | |

*Primary Examiner*—Carl D. Friedman
*Assistant Examiner*—Winnie Yip
*Attorney, Agent, or Firm*—Merchant, Gould, Smith, Edell, Welter & Schmidt, P.A.

[57] ABSTRACT

A positioning device for positioning a frame between two parallel form panels of a wall form assembly when pouring concrete includes a positioning plate and two seal strips. The positioning plate is adapted to be fastened to one of the panels and has a planar positioning surface which abuts against the frame and which is adapted to be perpendicular to the panel. The seal strips are adapted to be located on two sides of the frame between the panels such that each of the strips is positioned between the frame and one of the panels. A liquid-tight seal is established between the frame and the panels. Assembly of the frame and the seal strips defines between the panels a concrete pouring space and a non-pouring space which are located on two sides of the assembly. The positioning plate is located in the non-pouring space, and the frame is positioned between the positioning plate and the concrete pouring space.

5 Claims, 8 Drawing Sheets

DEVICE FOR TEMPORARILY POSITIONING A FRAME TO BE CONNECTED SECURELY TO A CONCRETE WALL DURING CONSTRUCTION OF THE CONCRETE WALL

BACKGROUND OF THE INVENTION

1. Field of the Invention

The invention relates to a positioning device, more particularly to a positioning device which is used to position a frame in a wall form assembly during pouring of concrete to form a concrete wall.

2. Description of the Related Art

Usually, when constructing concrete structures, such as houses and the like, a large amount of time and manpower is wasted on the nailing of wooden panels to assemble mold forms prior to pouring of concrete and on the disassembly of the mold forms when the concrete hardens. Recent advancement in the field of construction has resulted in the development of reusable unitary or modular wall form assemblies which permit fast and efficient construction of concrete structures at a lower manpower requirement.

Prior to pouring of concrete into the mold form assembly to form the concrete wall, partition plates, which are interconnected to define an opening therethrough, are positioned within the mold form assembly. After concrete has been poured and the concrete wall hardens, the partition plates and the mold form assembly can be disassembled and removed from the concrete wall, thereby forming the opening which has a size that is generally larger than the frame to be fixed therein. Attachment of the window or door frame to the opening of the concrete wall unavoidably involves a plurality of processes, such as drilling of holes in the concrete wall, fixing the frame by means of locking bolts and patching of gaps that are formed between the frame and the concrete wall by cement and the like. This results in extra cost and in a waste of manpower.

SUMMARY OF THE INVENTION

The main object of this invention is to provide a positioning device, whereby a frame can be temporarily positioned when pouring concrete to form a concrete structure in such a manner that the frame is connected securely to the concrete wall of the structure after the latter hardens.

Another object of this invention is to provide a positioning device which can be reused so that the costs incurred in constructing concrete structure is consequently reduced.

According to this invention, a positioning device is used to position a frame between two parallel form panels of a wall form assembly during the pouring of concrete. The positioning device includes a positioning plate which is adapted to be fastened to one of the form panels and which has a planar positioning surface that abuts against the frame, and two seal strips adapted to be located on two sides of the frame between the form panels in such a manner that each of the seal strips is positioned between the frame and one of the form panels so as to establish a liquid-tight seal between the frame and the form panels. Assembly of the frame and the seal strips defines between the form panels a concrete pouring space and a non-pouring space which are located on two sides of the assembly. The positioning plate is located in the non-pouring space. The frame is positioned between the positioning plate and the concrete pouring space.

After concrete has been poured and the concrete wall hardens, the frame for holding a window or door is attached securely to an inner peripheral portion of the concrete wall that defines an opening. Therefore, when the positioning device of this invention is used to position temporarily the frame during the concrete pour, lots of manpower and expense can be saved. Consequently, the construction period can be shortened.

DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENTS

The positioning device of this invention is used to position a frame between two parallel form panels of a wall form assembly when pouring concrete to form a concrete wall.

Figure 1:
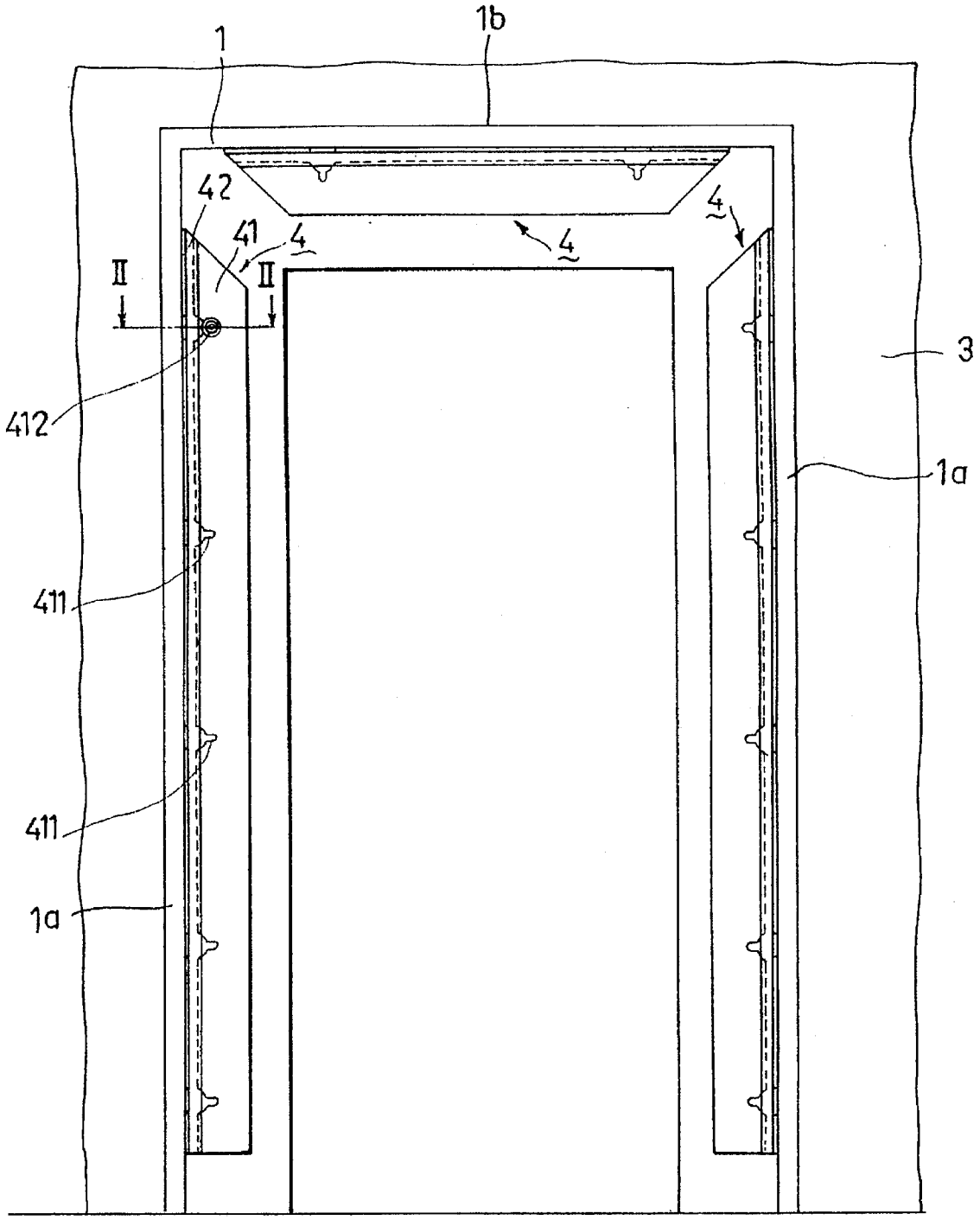
FIG. 1 illustrates how a first preferred embodiment of a positioning device of this invention positions a frame between two parallel form panels of a wall form assembly.
Figure 2:
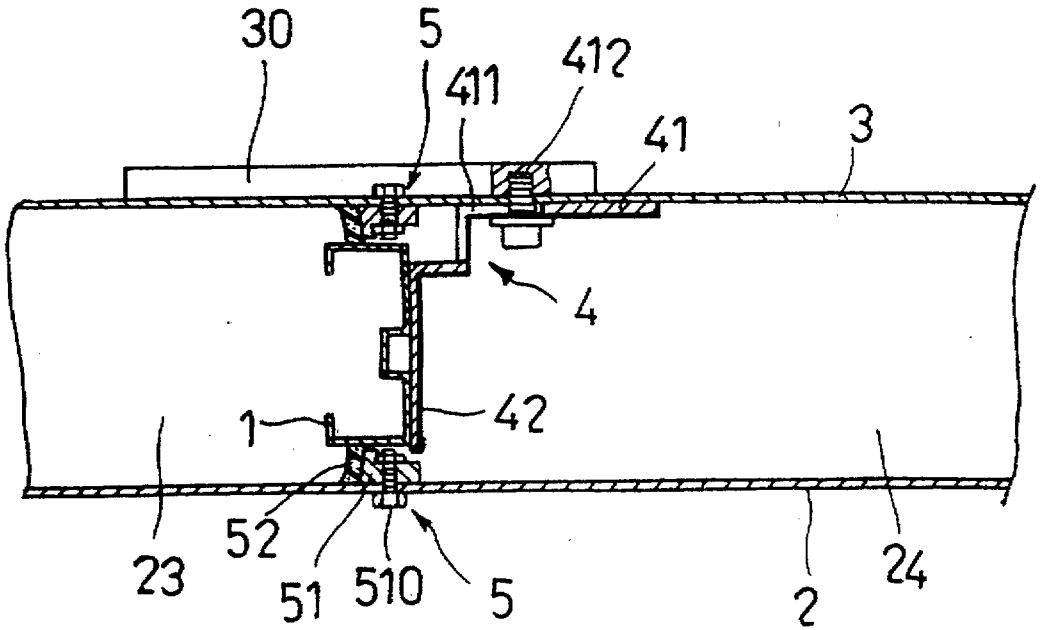
FIG. 2 is a sectional view of the first preferred embodiment taken along line II—II in FIG. 1.

Referring to FIGS. 1 and 2, three positioning devices of this invention are used to position a door frame 1 constituted by two vertical portions 1*a* and a horizontal portion 1*b* which interconnects the vertical portions 1*a*.

Each of the positioning devices is used to position one of the portions 1*a*, 1*b* of the door frame 1 between two parallel panels 2, 3 and includes an elongated positioning plate 4 and a pair of elongated seal strips 5 (see FIG. 1). Each of the positioning plates 4 has a mounting portion 41 formed with a plurality of parallel slots 411 (see FIG. 1), and an abutting portion 42 formed integrally with the mounting portion 41. Each of the abutting portions 42 has a planar positioning surface which abuts against the door frame 1 and which is perpendicular to the panels 2, 3. As best shown in FIG. 2, a lock bolt 412 is inserted through the respective slot 411 of the positioning plate 4 and through the form panel 3, and is threaded in a retaining plate 30 so as to lock the positioning plate 4 on the form panel 3. The retaining plate 30 may be replaced with several nuts (not shown). As illustrated, the lock bolts 412 can slide within the slots 411 of the positioning plate 4 in a direction parallel to the form panels 2, 3 so as to adjust position of the positioning plate 4 relative to the form panel 3. The seal strips 5 are made of a flexible material, such as polyurethane, and are disposed on two sides of the frame 1 between the form panels 2, 3. Each of the seal strips 5 includes an L-shaped connecting plate 51 screwed to a respective one of the form panels 2, 3, and an elongated curved seal 52 secured adhesively to the L-shaped connecting plate 51 in such a manner that the curved seal 52 is clamped between the frame 1 and one of the form panels 2, 3 so as to establish a liquid-tight seal between the frame 1 and the form panels 2, 3. Assembly of the frame 1 and the seal strips 5 defines between the form panels 2, 3 a concrete pouring space 23 and a non-pouring space 24 which are located on two sides of the assembly. The positioning plate 4 is located in the non-pouring space 24 in such a manner that the frame 1 is positioned between the positioning plate 4 and the concrete pouring space 23. Thus, after concrete has been poured and the concrete wall hardens, the form panels 2, 3, the positioning plate 4 and the seal strips 5 can be disassembled and removed from the concrete wall such that the frame 1 is connected securely to the inner peripheral portion of the concrete wall (not shown).

Figure 3:
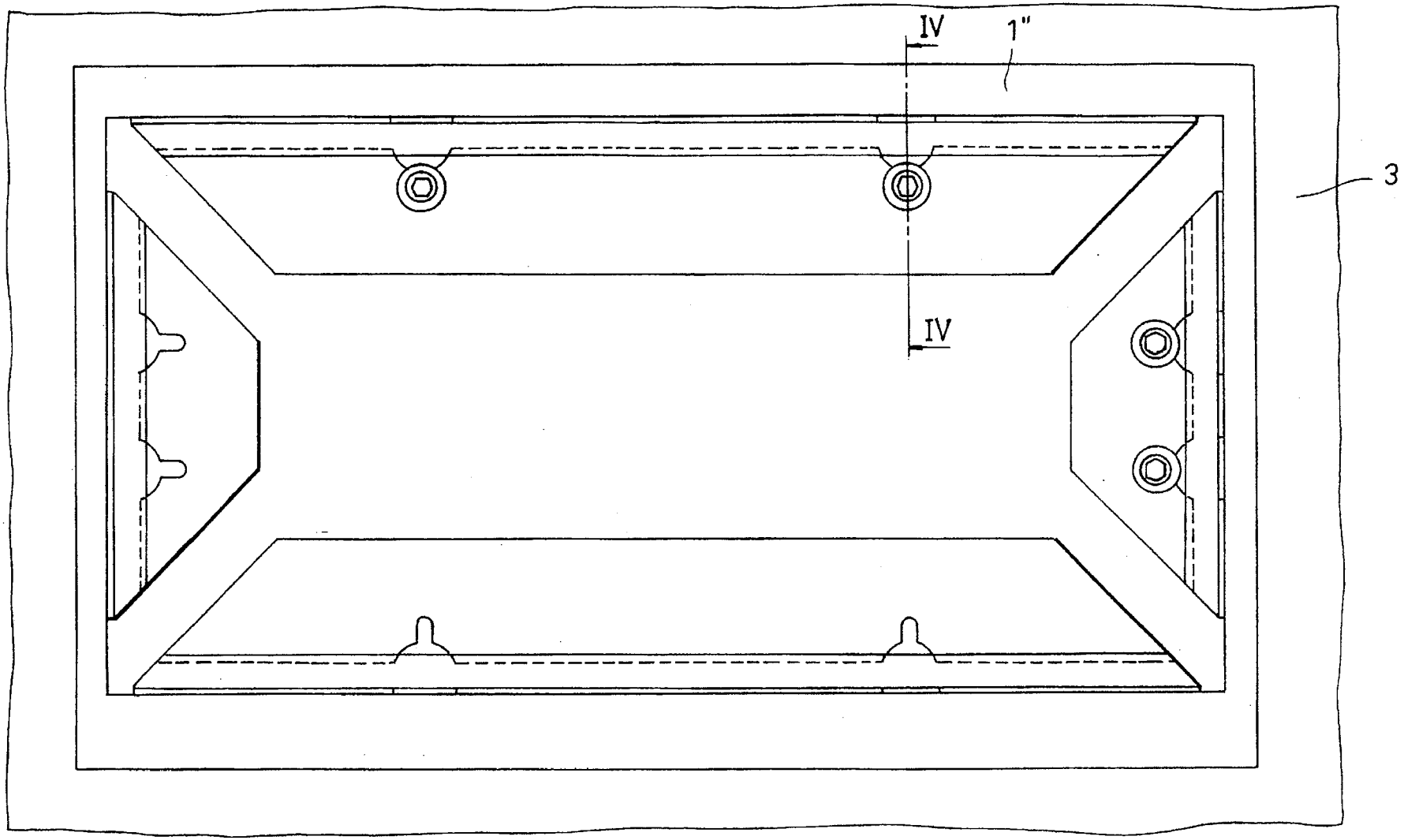
FIG. 3 illustrates how a second preferred embodiment of this invention positions a frame between two parallel form panels of a wall form assembly.
Figure 4:
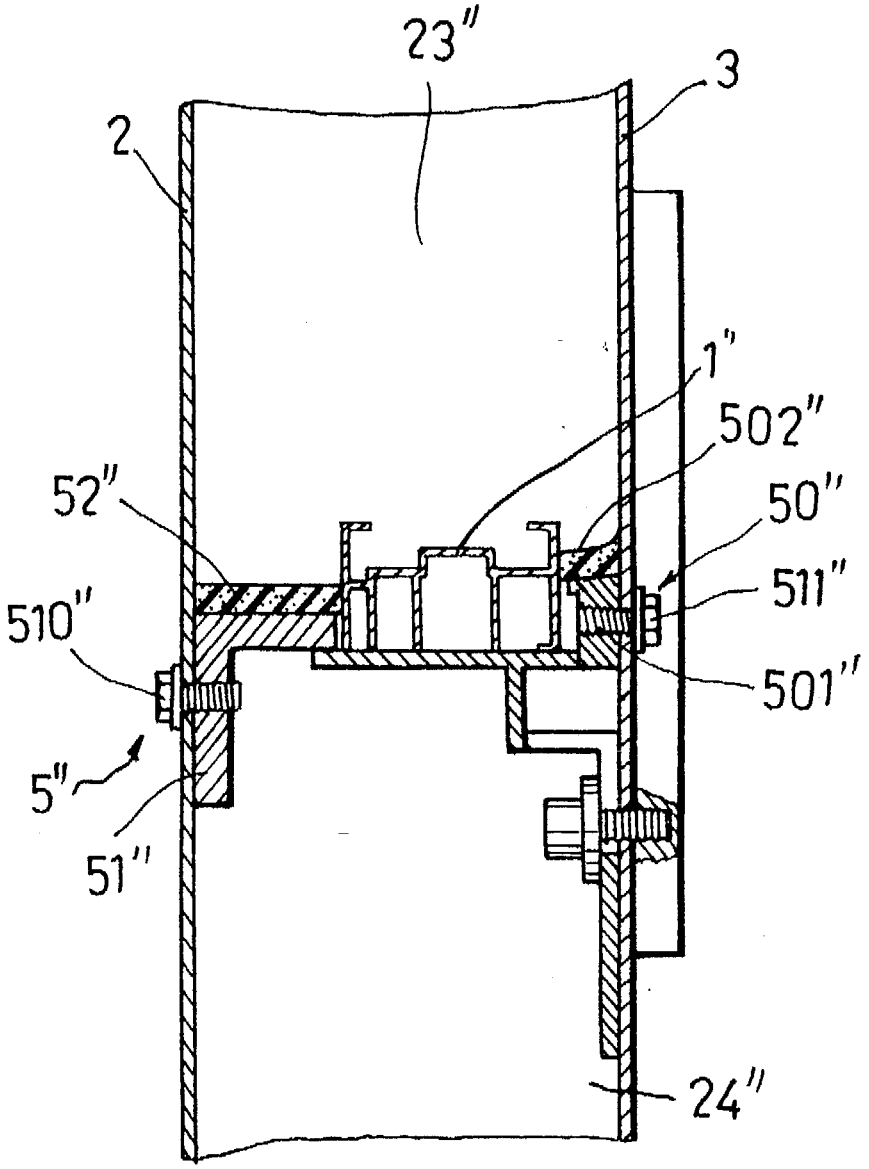
FIG. 4 is a sectional view of the second preferred embodiment taken along line IV—IV in FIG. 3.

A modified preferred embodiment of this invention is shown in FIGS. 3 and 4. As illustrated, the seal strips 5", 50" include two L-shaped connecting plates 51", 501" of different sizes which are respectively screwed to the form panels 2, 3 by two lock bolts 510", 511", and two seals 52", 502" of different widths which are respectively adhered to the connecting plates 51", 501" so as to be clamped between a window frame 1" and the form panels 2, 3 in order to establish a liquid-tight seal between the frame 1" and the form panels 2, 3. Thus, as illustrated in FIG. 4, a concrete pouring space 23" and a non-pouring space 24" are defined on two sides of the assembly constituted by the frame 1" and the seal strips 5", 50".

Figure 5:
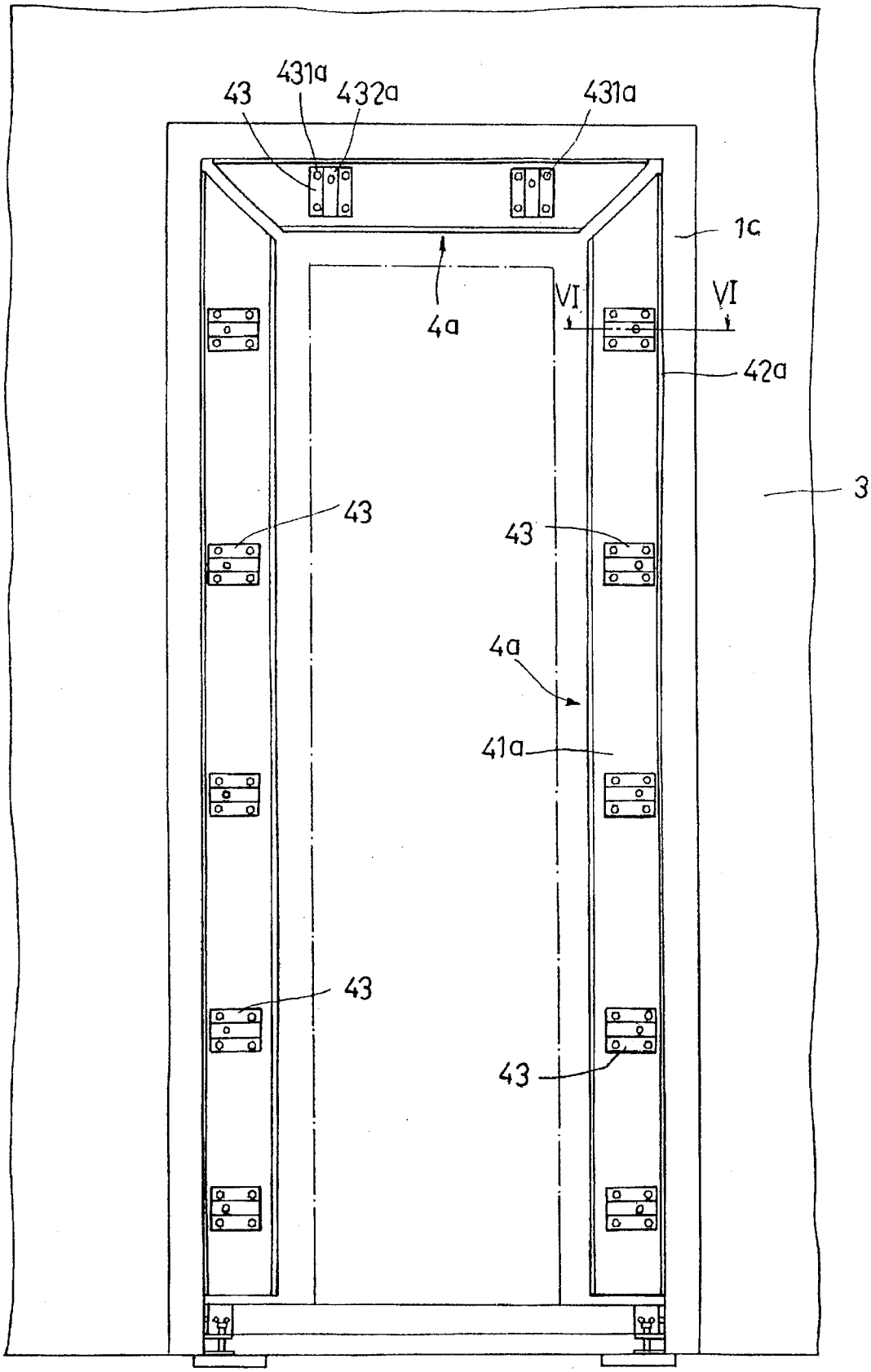
FIG. 5 illustrates how a third preferred embodiment of this invention positions a frame between two parallel form panels of a wall form assembly.
Figure 6:
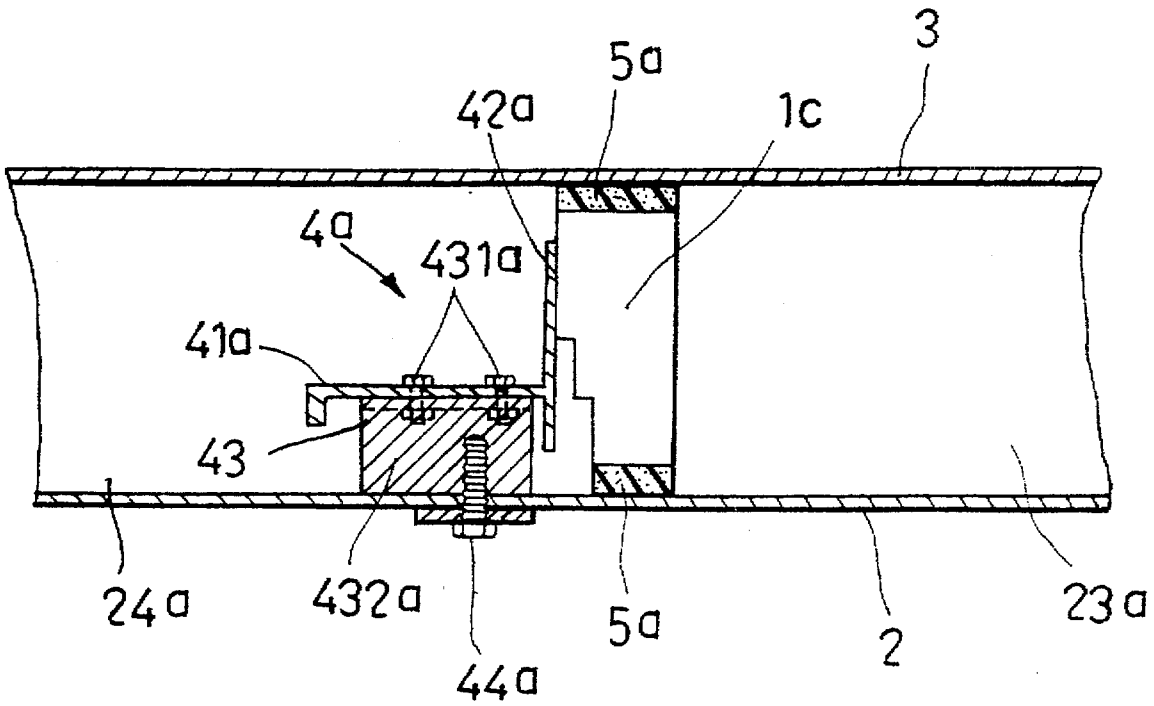
FIG. 6 is a sectional view of the third preferred embodiment taken along line VI—VI in FIG. 5.

Referring to FIGS. 5 and 6, in another preferred embodiment, a positioning plate **4*a* has an abutting portion 42*a* with a planar positioning surface which abuts against a door frame 1*c*, and a mounting portion 41*a* which is formed integrally with the abutting portion 42*a* and which is attached to a plurality of T-shaped coupling blocks 43 (see FIG. 5) by means of small bolts 431*a*. Each of the coupling blocks 43*a* has a protruding middle portion 432*a* that is fastened to the form panel 2 by means of a large bolt 44*a*. The seal strips 5*a* are made from ethyl vinyl acetate and are connected adhesively to the form panels 2, 3. Thus, a concrete pouring space 23*a* and a non-pouring space 24*a* are formed between the form panels 2, 3 and are located on two sides of the assembly constituted by the door frame 1*c* and the seal strips 5*a***.

Figure 7:
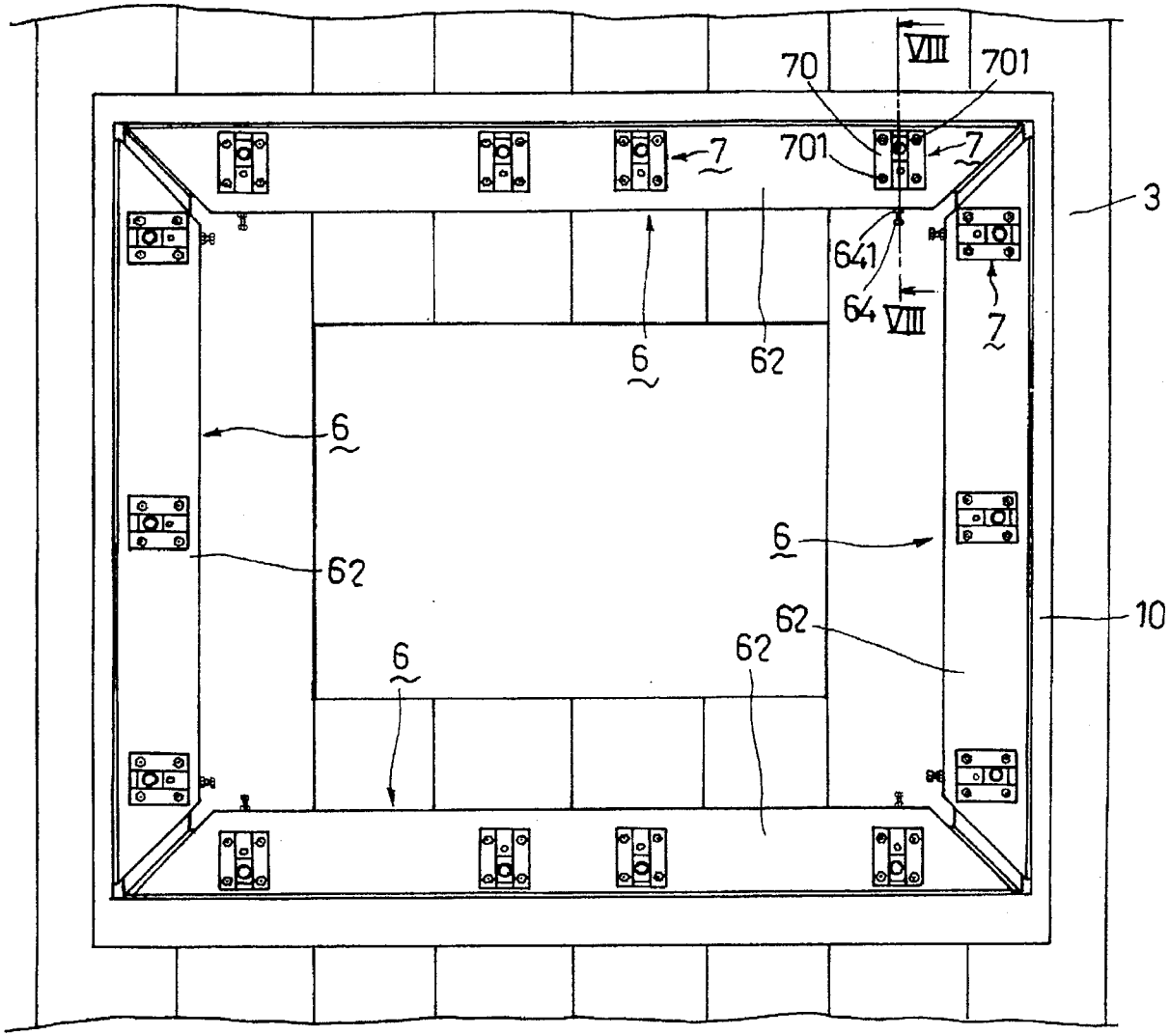
FIG. 7 illustrates how a fourth preferred embodiment of this invention positions a frame between two parallel form panels of a wall form assembly.
Figure 8:
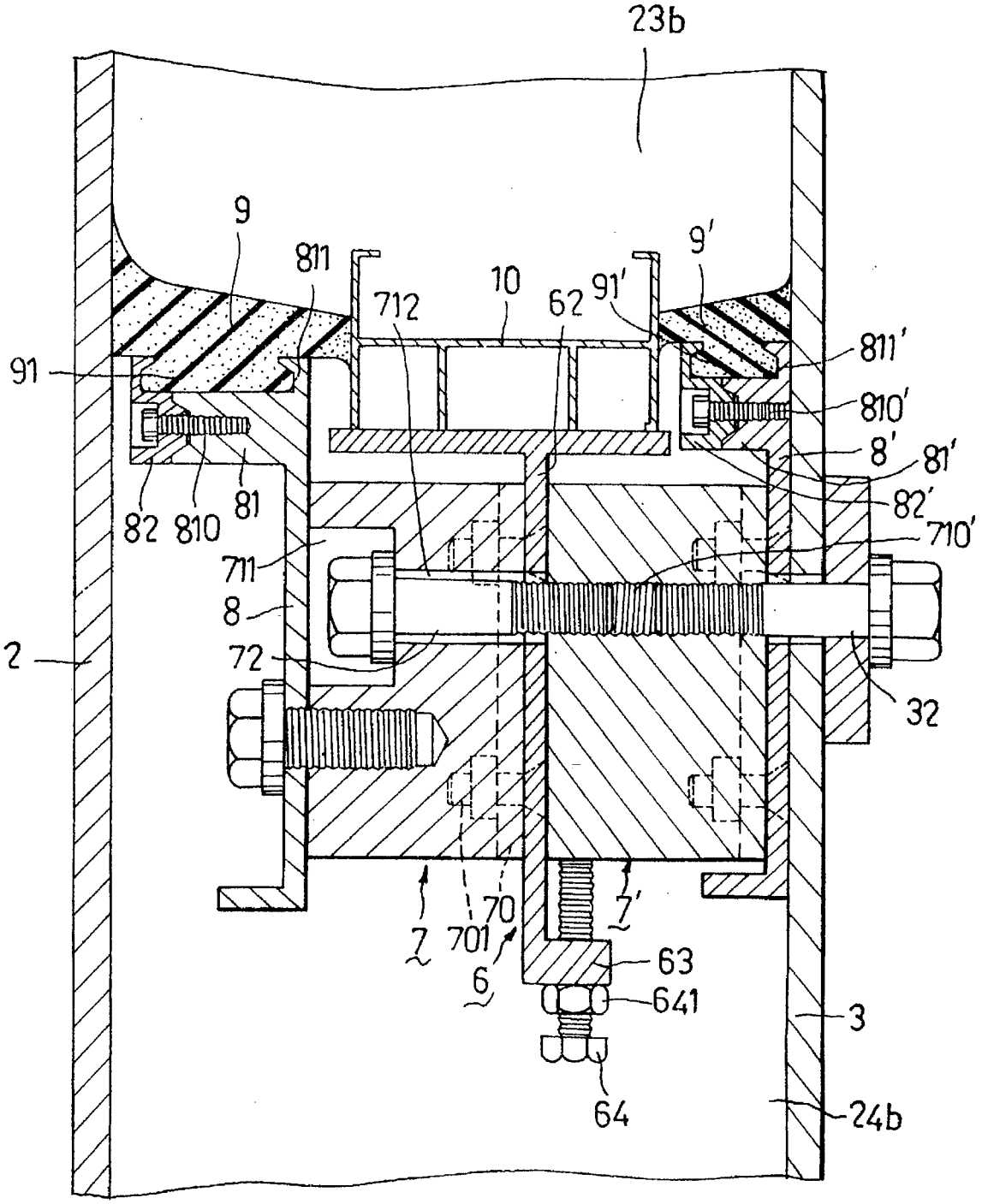
FIG. 8 is a sectional view of the fourth preferred embodiment taken along line VIII—VIII in FIG. 7.

FIGS. 7 and 8 show another embodiment of this invention. As illustrated, four positioning devices are used to position temporarily a window frame 10 in the wall form assembly. Unlike the previous embodiments, each of the positioning devices further includes a plurality of T-shaped coupling blocks 7, 7' and a plurality of elongated strip holders 8, 8' (see FIG. 8). Each of the right coupling block 7' has a threaded hole 710' formed therethrough and fastened to the form panel 3 by a right bolt 32 which extends through the form panel 3 and one of the right strip holders 8' to engage the right portion of the threaded hole 710' of the right block 7'. Each of the left blocks 7 has a recess 711 communicated with a through hole 712 formed therethrough and disposed on one side of the mounting portion 62 of each of the positioning plates 6 such that the abutting face 70 of the left block 7 abuts against the mounting portion 62. Each of the left blocks 7 is fastened to the corresponding right block 7' by a left bolt 72 which extends through the through-hole 712 of the left block 7, and through the mounting portion 62 and is threaded in the left portion of the threaded hole 710', thereby securing the blocks 7, 7' on the form panel 3. The left strip holders 8 is bolted to the left block 7. Each of the left and right strip holders 8, 8' has a fixed jaw 81, 81' a movable jaw 82, 82' mounted movably on the fixed jaw 81, 81' and a small adjustment bolt 810, 810' actuatable to move the movable jaw 82, 82' relative to the fixed jaw 81, 81' so as to define a dovetail groove 811, 811' between the fixed and movable jaws 81, 81', 82, 82'. The seal strips 9, 9' are located on two sides of the frame 10 between the form panels 2,3. Each of the seal strips 9, 9' has an integral dovetail tongue 91, 91' engaged within a corresponding one of the dovetail grooves 811, 811' of the strip holders 8, 8' so as to establish a liquid-tight seal between the window frame 10 and the form panels 2, 3. Assembly of the window frame 10 and the seal strips 9, 9' defines between the form panels 2, 3 a concrete pouring space **23*b* and a non-pouring space 24*b* which are located on two sides of the assembly. As illustrated, the positioning plate 6 is located in the non-pouring space 24*b***.

The positioning plate 6 has an L-shaped portion 63 formed with a threaded-hole therethrough, and a large adjustment bolt 64 which extends through the threaded-hole of the L-shaped portion 63 to press against the right coupling block 7', thereby permitting movement of the positioning plate 6 relative to the form panels 2, 3 in a direction parallel to the form panels 2, 3. Thus, adjustments to the position of the frame 10 can be performed when the locking bolt 32 and the threaded nut 641 are released.

After concrete has been poured and the concrete wall hardens, the wall form assembly and the positioning device of this invention are disassembled and removed from the concrete wall. The frame is attached securely to an inner peripheral portion of the concrete wall that defines an opening for mounting a door or window therein. Therefore, lots of manpower and expense can be saved and consequently, the construction period can be shortened.

With this invention thus explained, it is apparent that numerous modifications and variations can be made without departing from the scope and spirit of this invention. It is therefore intended that this invention be limited only as indicated in the appended claims.

I claim:

1. A positioning device for positioning a frame between two parallel form panels of a wall form assembly when pouring concrete, the device comprising:

a positioning plate adapted to be fastened to one of the form panels and having a planar positioning surface which abuts against the frame and which is adapted to be perpendicular to the form panels;

two strip holders adapted to be disposed between the form panels, each of the strip holders being adapted to be coupled with either the positioning plate or said one of the form panels; and two seal strips adapted to be disposed on two sides of the frame between the form panels in such a manner that each of the strips is positioned between the frame and one of the form panels and each of which is held by a respective one of the strip holders so as to establish a liquid-tight seal between the frame and the form panels, such that an assembly of the frame and the seal strips defines, between the form panels, a concrete pouring space and a non-pouring space on two sides of the assembly, the positioning plate and the two strip holders being located in the non-pouring space; whereby concrete is to be poured into the concrete pouring space.

2. A positioning device as defined in claim 1, wherein each of the strip holders has a dovetail groove formed therein, each of the seal strips having an integral dovetail tongue engaged within a corresponding one of the dovetail grooves of the strip holders.

3. A positioning device as claimed in claim 2, wherein each of the strip holders includes a fixed jaw connected securely to the positioning plate, a movable jaw mounted movably on the fixed jaw, and a small adjustment bolt interconnecting the fixed jaw and the movable jaw and being actuatable to move the movable jaw relative to the fixed jaw so as to define the dovetail groove between the fixed and movable jaws, and so as to clamp a corresponding one of the seal strips between the fixed jaw and the movable jaw.

4. A positioning device as defined in claim 1, further comprising two coupling blocks connected respectively and securely to the strip holder and the positioning plate.

5. A positioning device as claimed in claim 4, wherein the positioning plate has an L-shaped portion with a threaded hole formed therethrough, and a large adjustment bolt which extends through the hole of the positioning plate to press against one of the coupling blocks, the large adjustment bolt being adjustable to move the positioning plate relative to the form panels in a direction parallel to the form panels.

* * * * *